US006431597B1

(12) United States Patent
Helmy et al.

(10) Patent No.: US 6,431,597 B1
(45) Date of Patent: Aug. 13, 2002

(54) REDUCED SMOKE GAS GENERANT WITH IMPROVED MECHANICAL STABILITY

(75) Inventors: Abdelkader M. Helmy, Sparks, NV (US); Wen Tong, Chandler, AZ (US)

(73) Assignees: TRW Inc.; TRW Vehicle Safety Systems Inc., both of Lyndhurst, OH (US)

( * ) Notice: Subject to any disclaimer, the term of this patent is extended or adjusted under 35 U.S.C. 154(b) by 0 days.

(21) Appl. No.: 09/579,656

(22) Filed: May 26, 2000

(51) Int. Cl.[7] ..... C06B 45/10; B60R 21/28

(52) U.S. Cl. ..... 280/741; 149/19.1; 149/19.91; 149/36

(58) Field of Search ..... 149/19.4, 19.91, 149/19.1; 280/741

(56) References Cited

U.S. PATENT DOCUMENTS

| | | | | | |
|---|---|---|---|---|---|
| 3,940,298 | A | * | 2/1976 | Beckert et al. | 149/92 |
| 4,369,079 | A | * | 1/1983 | Shaw | 149/2 |
| 4,875,949 | A | * | 10/1989 | Mishra et al. | 149/19.4 |
| 5,281,706 | A | * | 1/1994 | Coburn et al. | 544/179 |
| 5,531,845 | A | * | 7/1996 | Flanigan et al. | 149/109.6 |
| 5,551,725 | A | * | 9/1996 | Ludwig | 280/737 |
| 5,773,754 | A | * | 6/1998 | Yamato | 149/36 |
| 5,872,329 | A | * | 2/1999 | Burns et al. | 149/36 |
| 5,917,146 | A | * | 6/1999 | Hiskey et al. | 149/36 |
| 6,156,137 | A | * | 12/2000 | Lundstrom et al. | 149/45 |
| 6,214,139 | B1 | * | 4/2001 | Hiskey et al. | 149/36 |
| 6,231,701 | B1 | * | 5/2001 | Bloomquist | 149/18 |

OTHER PUBLICATIONS

Co–pending U.S. Blomquist Patent appln. Ser. No. 09/292, 628, Filed Apr. 1, 1999 entitled "Reduced Smoked Gas Generant with Improved Temperature Stability".

* cited by examiner

*Primary Examiner*—Edward A. Miller
(74) *Attorney, Agent, or Firm*—Tarolli, Sundheim, Covell, Tummino & Szabo L.L.P.

(57) ABSTRACT

An apparatus (12) comprises an inflatable vehicle occupant protection device (20) and a gas generating material (16) that when ignited produces gas to inflate the inflatable vehicle occupant protection device (20). The gas generating material (16) includes an inorganic salt oxidizer, a water-soluble binder, and about 1 to about 10% of a supplemental fuel selected from the group consisting of 3,6-dihydrazino-1,2,4,5-tetrazine, 3,6-diamino-1,2,4,5-tetrazine-1,4-dioxide, and 3,6-diamino-1,2,4,5-tetrazine, and combinations thereof.

20 Claims, 1 Drawing Sheet

REDUCED SMOKE GAS GENERANT WITH IMPROVED MECHANICAL STABILITY

FIELD OF THE INVENTION

The present invention relates to an apparatus comprising an inflatable vehicle occupant protection device, and particularly relates to a gas generating material for providing inflation gas for inflating an inflatable vehicle occupant protection device.

BACKGROUND OF THE INVENTION

An inflator for inflating an inflatable vehicle occupant protection device, such as an air bag, contains an ignitable gas generating material. The inflator further includes an igniter. The igniter is actuated so as to ignite the gas generating material when the vehicle experiences a collision for which inflation of the air bag is desired to help protect a vehicle occupant. As the gas generating material burns, it generates a volume of inflation gas. The inflation gas is directed into the air bag to inflate the air bag. When the air bag is inflated, it expands into the vehicle occupant compartment and helps to protect the vehicle occupant.

It is desirable that the gas generating material for inflating an inflatable vehicle occupant protection device meet a number of technical requirements. For instance, the gas generated by combustion of the gas generating material should be substantially free of toxic materials. It should also preferably be essentially smoke-free. The gas generating material must be chemically and physically stable over a wide temperature range, and should have ignition and combustion characteristics suitable for use with a vehicle occupant protection device.

SUMMARY OF THE INVENTION

The present invention is an apparatus comprising an inflatable vehicle occupant protection device and a gas generating material that when ignited produces gas to inflate the inflatable vehicle occupant protection device. The gas generating material includes an inorganic salt oxidizer, a water soluble binder, and about 1 to about 10% of a supplemental fuel selected from the group consisting of 3,6-dihydrazino-1,2,4,5-tetrazine, 3,6-diamino-1,2,4,5-tetrazine-1,4-dioxide, 3,6-diamino-1,2,4,5-tetrazine, and combinations thereof.

BRIEF DESCRIPTION OF THE DRAWINGS

The foregoing and other features of the invention will become more apparent to one skilled in the art upon consideration of the following description of the invention and the accompanying drawing in which the FIGURE is a schematic illustration of an apparatus embodying the present invention.

DESCRIPTION OF PREFERRED EMBODIMENTS

Figure 1:
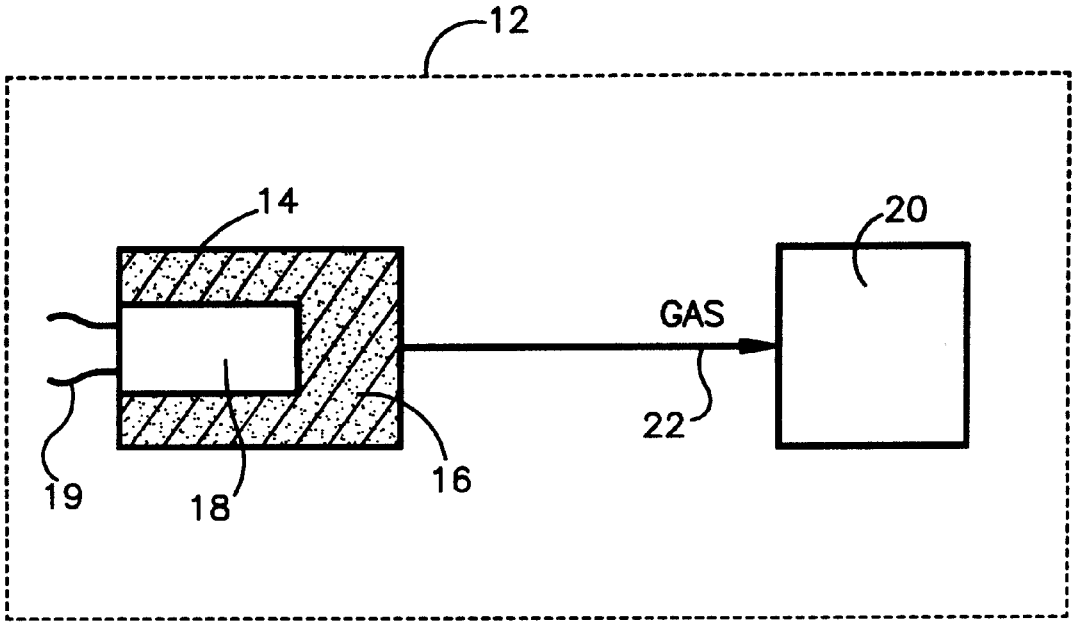

Referring to the FIGURE, an apparatus 12 embodying the present invention comprises an inflator 14. The inflator 14 contains a gas generating material 16. The gas generating material 16 is ignited by an igniter 18 operatively associated with the gas generating material 16. Electric leads 19 convey current to the igniter 18 as part of an electric circuit that includes a sensor (not shown), which is responsive to vehicle deceleration above a predetermined threshold. The apparatus 10 also comprises a vehicle occupant protection device 20. A gas flow means 22 conveys gas, which is generated by combustion of the gas generating material 16 in the inflator 14, to the vehicle occupant protection device 20.

A preferred vehicle occupant protection device 20 is an air bag, which is inflatable to protect a vehicle occupant in the event of a collision. Other vehicle occupant protection devices that can be used in the present invention are inflatable seat belts, inflatable knee bolsters, inflatable air bags to operate knee bolsters, inflatable head liners, and/or inflatable side curtains.

The gas generating material 16 of the present invention comprises an inorganic salt oxidizer, a water-soluble binder, and a supplemental fuel. The inorganic salt oxidizer can be any inorganic salt oxidizer commonly used in a gas generating material for inflating a vehicle occupant protection device. Examples of inorganic salt oxidizers that can be used in the gas generating material are alkali metal nitrates such as sodium nitrate and potassium nitrate, alkaline earth metal nitrates such as strontium nitrate and barium nitrate, alkali metal perchlorates such as sodium perchlorate, potassium perchlorate, and lithium perchlorate, alkaline earth metal perchlorates, ammonium perchlorate, ammonium nitrate, or a mixture thereof.

A preferred inorganic salt oxidizer is ammonium nitrate. Ammonium nitrate is preferred because it produces upon combustion a gas product essentially free of smoke and toxic gases.

When ammonium nitrate is used as the oxidizer, the ammonium nitrate is preferably phase stabilized. The phase stabilization of ammonium nitrate is well known. In one method, the ammonium nitrate is doped with a metal cation in an amount that is effective to minimize the volumetric and structural changes associated with phase transitions to pure ammonium nitrate. A preferred phase stabilizer is potassium nitrate. Other useful phase stabilizers include potassium salts such as potassium dichromate, potassium oxalate, and mixtures of potassium dichromate and potassium oxalate. Ammonium nitrate can also be stabilized by doping with copper and zinc ions. Other compounds, modifiers, and methods that are effective to phase stabilize ammonium nitrate are well known and suitable in the present invention.

Ammonium perchlorate, although a good oxidizer, is preferably combined with a non-halogen alkali metal or alkaline earth metal salt. Preferred mixtures of ammonium perchlorate and a non-halogen alkali metal or alkaline earth metal salt are ammonium perchlorate and sodium nitrate, ammonium perchlorate and potassium nitrate, and ammonium perchlorate and lithium carbonate. Ammonium perchlorate produces upon combustion hydrogen chloride. Non-halogen alkali metal or alkaline earth metal salts react with hydrogen chloride produced upon combustion to form alkali metal or alkaline earth metal chloride. Preferably, the non-halogen alkali metal or alkaline earth metal salt is present in an amount sufficient to produce a combustion product that is substantially free (i.e., less than 2% by weight of the combustion product) of hydrogen chloride.

The amount of inorganic salt oxidizer in the gas generating material is that amount necessary to achieve sustained combustion of the gas generating material. The amount of inorganic salt oxidizer necessary to achieve sustained combustion of the gas generating material is from about 60% to about 90% by weight of the gas generating material. A preferred amount of inorganic salt oxidizer is that amount necessary to oxygen balance the gas generating material and produce, upon combustion with the water soluble binder and the supplemental fuel, a combustion product that is substantially free of carbon monoxide. By substantially free of carbon monoxide, it is meant that the volume of carbon monoxide is less than about 4% by volume of gas produced upon combustion. A preferred amount of oxidizer is from about 60% to about 80% by weight of the gas generating material.

The gas generating material also includes a water-soluble binder that has a high temperature thermal stability and a sufficient number of carbon atoms to function as a fuel and produce, with the inorganic salt oxidizer, a combustible mixture. A preferred binder is polyvinyl alcohol. Polyvinyl alcohol can be represented by the following formula:

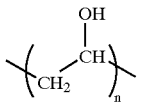

Polyvinyl alcohol is made by the alcoholysis of polyvinyl acetate. It is commercially available, from Aldrich Chemical Co. Inc., Milwaukee, Wis., as a white cream powder in a range of average molecular weights, from a low molecular weight, low viscosity grade (below 35,000 molecular weight) to a super high molecular weight, super high viscosity grade (250,000 to 300,000 molecular weight). A preferred molecular weight in the present invention is within the range between a low viscosity grade, which is 87% to 89% hydrolyzed and has an average molecular weight of about 13,000 to 23,000, to a mid-viscosity grade, which is 99+% hydrolyzed and has an average molecular weight of about 124,000 to 186,000. A more preferred molecular weight is about 96,000, which is about 99+% hydrolyzed.

Preferably, the polyvinyl alcohol is cross-linked. Suitable cross-linking agents for cross-linking polyvinyl alcohol include organo-metallic complexes such as water-soluble organic titanates and water-soluble organic zirconates. Two suitable cross-linking agents are "TYZOR" TE and "TYZOR" LA. "TYZOR" TE and "TYZOR" LA are organic titanates commercially available from E.I. du Pont de Nemours and Company. "TYZOR" TE (triethanolamine titanate chelate) is a mixture of chelates with at least one chelate with the following structural formula:

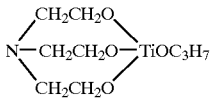

"TYZOR" LA (lactic acid titanate chelate ammonium salt) has the following structural formula:

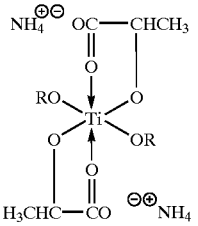

The cross-linking of the polyvinyl alcohol is carried out in an aqueous medium, for instance, by dissolving the polyvinyl alcohol in water and adding the cross-linking agent to the polyvinyl alcohol solution. The cross-linking agent undergoes alcoholysis with the polyvinyl alcohol upon heating the polyvinyl alcohol solution. For example, "TYZOR" TE undergoes alcoholysis with the polyvinyl alcohol as follows:

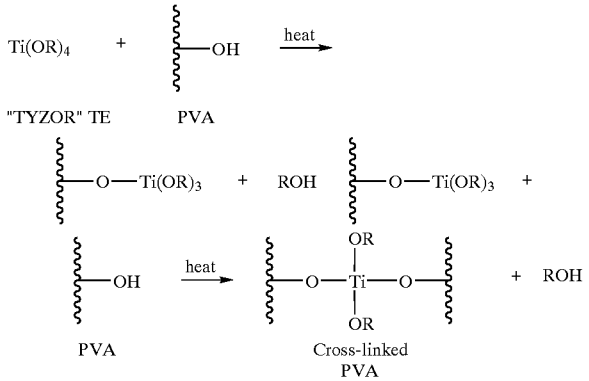

Other water soluble binders containing substantial carbon atoms and having high temperature thermal stability so as to be useful as fuels include hydroxyl ethyl acrylates, cellulose derivatives such as carboxymethylcellulose and hydroxylpropylcellulose, polymers derived from vinyl esters such as polyvinylpyrolidone or polyvinyl amides, starches such as carboxymethyl starch, alginates, casein, gums, lattices such as styrene-butadiene latex, and mixtures of the same, including mixtures with polyvinyl alcohol.

The amount of binder in the gas generating material is that amount of binder sufficient to achieve sustained combustion of the gas generating material and form a gas generating material that has good mechanical properties. The inflator must function properly over a wide temperature range, for instance, from a low of about −40° C. to a high of about 90° C. This means that the gas generating material must have good elasticity and good tensile strength over a wide temperature range. It must be neither brittle at −40° C. nor capable of losing its shape or configuration at 90° C. A preferred amount of binder to achieve these properties is in the range of about 5% to about 25% by weight of the gas generating material.

The gas generating material of the present invention further comprises a supplemental fuel to increase the burn rate and impetus of the gas generating material. A preferred supplemental fuel is selected from the group consisting of 3,6-dihydrazino-1,2,4,5-tetrazine, 3,6-diamino-1,2,4,5-tetrazine-1,4-dioxide, 3,6-diamino-1,2,4,5-tetrazine, and combinations thereof.

3,6-dihydrazino-1,2,4,5-tetrazine has the general formula $C_2H_6N_8$ and the following structure:

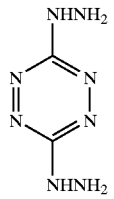

3,6-dihydrazino-1,2,4,5-tetrazine has molecular weight of 142 and heat of formation of 128 Kcal/mol (901.41 cal/g). 3,6-dihydrazino-1,2,4,5-tetrazine is commercially available from Los Alamos National Laboratory, Los Alamos, N. Mex.

3,6-diamino-1,2,4,5-tetrazine-1,4-dioxide has the general formula $C_2H_4N_6O_8$ and the following structure:

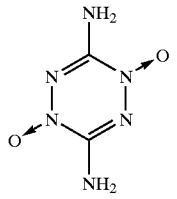

3,6-diamino-1,2,4,5-tetrazine-1,4-dioxide has a molecular weight of 144 and heat of formation of 39.2 Kcal/mol (272.2 cal/g). 3,6-diamino-1,2,4,5-tetrazine-1,4-dioxide is commercially available from Los Alamos National Laboratory, Los Alamos, N. Mex.

3,6-diamino-1,2,4,5-tetrazine has the general formula $C_2H_4N_6$ and the following structure:

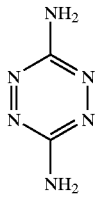

3,6-diamino-1,2,4,5-tetrazine has a molecular weight of 112 and a heat of formation of 71.2 Kcal/mol (636 cal/g). 3,6-diamino-1,2,4,5-tetrazine is commercially available from Los Alamos National Laboratory, Los Alamos, N. Mex.

3,6-dihydrazino-1,2,4,5-tetrazine, 3,6-diamino-1,2,4,5-tetrazine-1,4-dioxide, and 3,6-diamino-1,2,4,5-tetrazine are preferred as supplemental fuels because these fuels have a lower impact and friction sensitivity compared to conventional supplemental fuels such as cyclotrimethylenetrinitramine (RDX). For example, the impact sensitivity as measured by a 2 kg drop weight apparatus for 3,6-dihydrazino-1,2,4,5-tetrazine, 3,6-diamino-1,2,4,5-tetrazine-1,4-dioxide, and 3,6-diamino-1,2,4,5-tetrazine are respectively 68 cm, 76 cm, and greater than >320 cm compared to 38 cm for cyclotrimethylenetrinitramine. The friction sensitivity as measured with a Julius-Petri friction apparatus is >35 Kilo-pons for 3,6-dihydrazino-1,2,4,5-tetrazine, 3,6-diamino-1,2,4,5-tetrazine-1,4-dioxide, and 3,6-diamino-1,2,4,5-tetrazine compared to 12 Kilo-pons for cyclotrimethylenetrinitramine (RDX). A lower impact and friction sensitivity reduces the risk of accidental ignition of the gas generating material during processing and storage of the gas generating material.

The supplemental fuel is incorporated into the gas generating material in the form of a finely divided powder. The average particle size of the supplemental fuel is from about 0.5 $\mu$m to about 10 $\mu$m. Preferably, the average particle size of the fuel is about 5 $\mu$m.

The amount of supplemental fuel in the gas generating material is that amount sufficient to increase the burn rate and impetus of the gas generating material to a level effective to inflate a vehicle occupant protection device. A preferred amount is from about 1% to about 10% by weight of the gas generating material.

The present invention may also comprise other ingredients commonly added to a gas generating material for providing inflation gas for inflating an inflatable vehicle occupant protection device, such as process aids, burn rate modifiers, and ignition aids, all in relatively small amounts.

Preferably, the components of the gas generating material are present in a weight ratio adjusted to produce upon combustion a gas product that is substantially free of carbon monoxide. By substantially free of carbon monoxide, it is meant the amount of carbon monoxide in the combustion gas product is less than 4% by volume of the gas product.

EXAMPLE

A gas generating material was prepared by combining in a mixing device 75 grams of polyvinyl alcohol and 400 cc of de-ionized water. The polyvinyl alcohol had an average MW of between about 124,000 and about 186,000 and was 99+% hydrolyzed. The mixture of polyvinyl alcohol and de-ionized water was heated to a temperature in the range of about 60° C. to about 70° C. until the polyvinyl alcohol was dissolved in the de-ionized. About 365 grams of ammonium nitrate was then added to the polyvinyl alcohol solution. The average particle size of the ammonium nitrate was about 50 $\mu$m. The ammonium nitrate and polyvinyl alcohol solution was stirred until the ammonium nitrate was dissolved.

About 25 grams of "TYZOR" TE was added to and dissolved in the polyvinyl alcohol and ammonium nitrate solution. "TYZOR" TE is an organo-metallic cross-linking agent commercially available from E.I. DuPont de Nemours and Company of Wilmington, Del. The solution of TYZOR TE, ammonium nitrate, and polyvinyl alcohol was heated to temperature sufficient to partially cross-link the polyvinyl alcohol (i.e. about 60° C. to about 70° C.) and form a viscous solution having the consistency of viscous syrup.

About 30 grams of 3,6-diamino-1,2,4,5-tetrazine with an average particle size of about 5 $\mu$m was added to the viscous solution. The particles of 3,6-diamino-1,2,4,5-tetrazine were stirred in the viscous solution until the particles of 3,6-diamino-1,2,4,5-tetrazine were uniformly dispersed throughout the viscous solution and a viscous suspension was formed.

The viscous suspension was pumped into a spray dryer (Niro Mino-spray dryer, manufactured by Niro Inc., Columbia, Md.) and through a fluid nozzle to form spheroid droplets having an average diameter ranging from about 10 $\mu$m to about 100 $\mu$m. The droplets were passed through a counter-current of hot air, which had a temperature of about 110° C. The hot air caused evaporation of the water from the droplets as well as crystallization of the ammonium nitrate and cross-linking of the polyvinyl alcohol.

Spheroid particles of gas generating material were formed as a result of the spray drying process. The spheroid particles of gas generating material comprised particles of supplemental fuel encapsulated with cross-linked polyvinyl alcohol and crystallized ammonium nitrate. The spheroid particles had an average particle diameter of about 50 $\mu$m. The spheroid particles were neither brittle at −40° C. nor capable of losing their shape or configuration at 90° C.

The particulate gas generating material was tested for sensitivity to hazardous stimuli. The particulate gas generating material was found to be insensitive, measuring beyond the limit of laboratory instrumentation at more than 50 cm impact and 27 kilo-pons friction. Both values meet impact and friction criteria for a gas generating material for a vehicle occupant protection apparatus. Thermal analysis by differential scanning calorimetry revealed that the composition had a broad exotherm at a temperature of 296° C., indicating that the gas generating material decomposed into a gas at a steady rate.

The particulate gas generating material was compacted under a compaction pressure of about 11,000 ft-lb (1521 kg-m) into cylindrical pellets having a diameter of about 0.5 inch and a length of about 3 inches.

A cylindrical pellet was combusted in a closed bomb having a volume of 64.6 ml. The gas generating material produced 4.2 moles of gas per 100 gram of propellant. The flame temperature of the gas generating material was found to be less than 2200 and the specific heat ratio was found to be 1.21. A flame temperature of less than 2200 K is significant. The composition of the gas product is dependent on flame temperature of gas generating material. A higher flame temperature drives the reaction equilibrium, during combustion of the gas generating material, to facilitate the formation of carbon monoxide and nitrogen oxide. A lower flame temperature (i.e., below about 2200 K) facilitates the formation of carbon dioxide and nitrogen. The gas produced upon combustion of the gas generating material was non-toxic and consisted essentially of carbon dioxide, nitrogen, and water.

Advantages of the present invention should now be apparent. The gas generating material of the present invention offers improved mechanical stability without sacrificing chemical stability. Furthermore, the gas generating material of the present invention produces an improved gas product that is essentially non-toxic and free of particulates. The improvements in mechanical stability and quality of the gas product result from the use of a supplemental fuel that has a low impact and friction sensitivity as well as favorable oxygen balance. Moreover, the gas generating material has low flame temperature. A low flame temperature facilitates the production of a gas product that comprises carbon dioxide and nitrogen, as opposed to carbon monoxide and nitrogen oxide.

From the above description of the invention, those skilled in the art will perceive improvements, changes, and modifications. Such improvements, changes and modifications with the skill of the art are intended to be covered by the appended claims.

Having described the invention, the following is claimed:

1. An apparatus comprising an inflatable vehicle occupant protection device and a gas generating material that when ignited produces gas to inflate the inflatable vehicle occupant protection device, the gas generating material including an inorganic salt oxidizer, a water soluble binder, and about 1 to about 10% of a supplemental fuel selected from the group consisting of 3,6-dihydrazino-1,2,4,5-tetrazine, 3,6-diamino-1,2,4,5-tetrazine-1,4-dioxide, and 3,6-diamino-1,2,4,5-tetrazine, and combinations thereof.

2. The apparatus of claim 1 wherein said water-soluble binder is polyvinyl alcohol.

3. The apparatus of claim 2 wherein said inorganic salt oxidizer is ammonium nitrate.

4. The apparatus of claim 2 wherein said polyvinyl alcohol binder is cross-linked.

5. The apparatus of claim 4 wherein said polyvinyl alcohol is cross-linked with a cross-linking agent selected from the group consisting of water soluble organic titanates and water soluble organic zirconates.

6. The apparatus of claim 3 wherein the inorganic salt oxidizer, the water soluble binder, and the supplemental fuel are present in a weight ratio adjusted to produce upon combustion a gas product that is substantially free of carbon monoxide.

7. The apparatus of claim 1 wherein the gas generating material has a flame temperature less than 2200 K.

8. The apparatus of claim 1 wherein the gas generating material is in the form of compacted spheroid particles of gas generating material.

9. The apparatus of claim 8 wherein the spheroid particles comprise particles of supplemental fuel encapsulated with cross-linked polyvinyl alcohol and crystallized ammonium nitrate.

10. An apparatus comprising an inflatable vehicle occupant protection device and a gas generating material that, when ignited, produces gas to inflate the inflatable vehicle occupant protection device, the gas generating material including about 60% to about 80% of inorganic salt oxidizer, about 5% to about 25% polyvinyl alcohol, and about 1 to about 10% of a supplemental fuel selected from the group consisting of 3,6-dihydrazino-1,2,4,5-tetrazine, 3,6-diamino-1,2,4,5-tetrazine-1,4-dioxide, and 3,6-diamino-1,2,4,5-tetrazine.

11. The apparatus of claim 10 wherein said inorganic salt oxidizer is ammonium nitrate.

12. The apparatus of claim 10 wherein said polyvinyl alcohol binder is cross-linked.

13. The apparatus of claim 12 wherein said polyvinyl alcohol is cross-linked with a cross-linking agent selected from the group consisting of water soluble organic titanates and water soluble organic zirconates.

14. The apparatus of claim 10 wherein the inorganic salt oxidizer, the polyvinyl alcohol, and the supplemental fuel are present in a weight ratio adjusted to produce upon combustion a gas product that is substantially free of carbon monoxide.

15. The apparatus of claim 10 wherein the gas generating material is in the form of compacted spheroid particles of gas generating material.

16. The apparatus of claim 15 wherein the spheroid particles comprise particles of supplemental fuel encapsulated with the polyvinyl alcohol and crystallized ammonium nitrate.

17. An apparatus comprising an inflatable vehicle occupant protection device and a gas generating material that, when ignited, produces gas to inflate the inflatable vehicle occupant protection device, the gas generating material including an inorganic salt oxidizer, polyvinyl alcohol, and about 1% to about 10% of a supplemental fuel selected from the group consisting of 3,6-dihydrazino-1,2,4,5-tetrazine, 3,6-diamino-1,2,4,5-tetrazine-1,4-dioxide, and 3,6-diamino-1,2,4,5-tetrazine, wherein said polyvinyl alcohol is cross-linked with a cross-linking agent selected from the group consisting of water soluble organic titanates and water soluble organic zirconates.

18. The apparatus of claim 17 wherein said inorganic salt oxidizer is ammonium nitrate.

19. The apparatus of claim 17 wherein the inorganic salt oxidizer, the polyvinyl alcohol, and the supplemental fuel are present in a weight ratio adjusted to produce upon combustion a gas product that is substantially free of carbon monoxide.

20. The apparatus of claim 17 wherein the gas generating material produces at least 4.2 moles of gas per 100 grams of propellant.

* * * * *